US005636978A

United States Patent [19]

Sasaki

[11] Patent Number: 5,636,978

[45] Date of Patent: Jun. 10, 1997

[54] COMBUSTION APPARATUS

[75] Inventor: Hiroshi Sasaki, Kanagawa, Japan

[73] Assignee: Elco Co., Ltd., Kanagawa, Japan

[21] Appl. No.: 584,609

[22] Filed: Jan. 11, 1996

[30] Foreign Application Priority Data

Jan. 11, 1995 [JP] Japan ..... 7-018618

[51] Int. Cl.[6] ..... F23N 5/00

[52] U.S. Cl. ..... 431/69; 431/18; 431/71; 431/73; 431/255

[58] Field of Search ..... 431/73, 80, 69, 431/62, 63, 6, 18, 79, 255, 100

[56] References Cited

U.S. PATENT DOCUMENTS 3,330,133 7/1967 Kniebes ..... 431/18
3,723,045 3/1973 Reese ..... 431/18
4,150,938 4/1979 Renshaw et al. ..... 431/73
4,830,606 5/1989 Dillinger ..... 431/255
5,468,142 11/1995 Koziol ..... 431/255
5,478,232 12/1995 Dillinger ..... 431/255

*Primary Examiner*—James C. Yeung
*Attorney, Agent, or Firm*—Smith-Hill and Bedell

[57] ABSTRACT

A gas burning power supply section 10 for igniting gas includes a secondary battery and a solar battery for charging the secondary battery, and the operating voltage from the power supply section 10 is supplied to a gas ignition circuit 30, a flame detection circuit 50 for detecting the flame after the gas is ignited, and a solenoid valve-controlling timer circuit 60 for controlling the gas supply. A day/night discrimination circuit 100 is provided in association with the power supply section 10, and the ignition circuit 30, the flame detection circuit 50 and the timer circuit 60 are individually set in operation in accordance with a day/night discrimination output during the nighttime. In the event the flame of burning gas goes out halfway, the timer circuit 60 operates to perform a trial including reigniting operation, and if the reigniting fails during a trial period, the gas supply is automatically shut off.

8 Claims, 10 Drawing Sheets

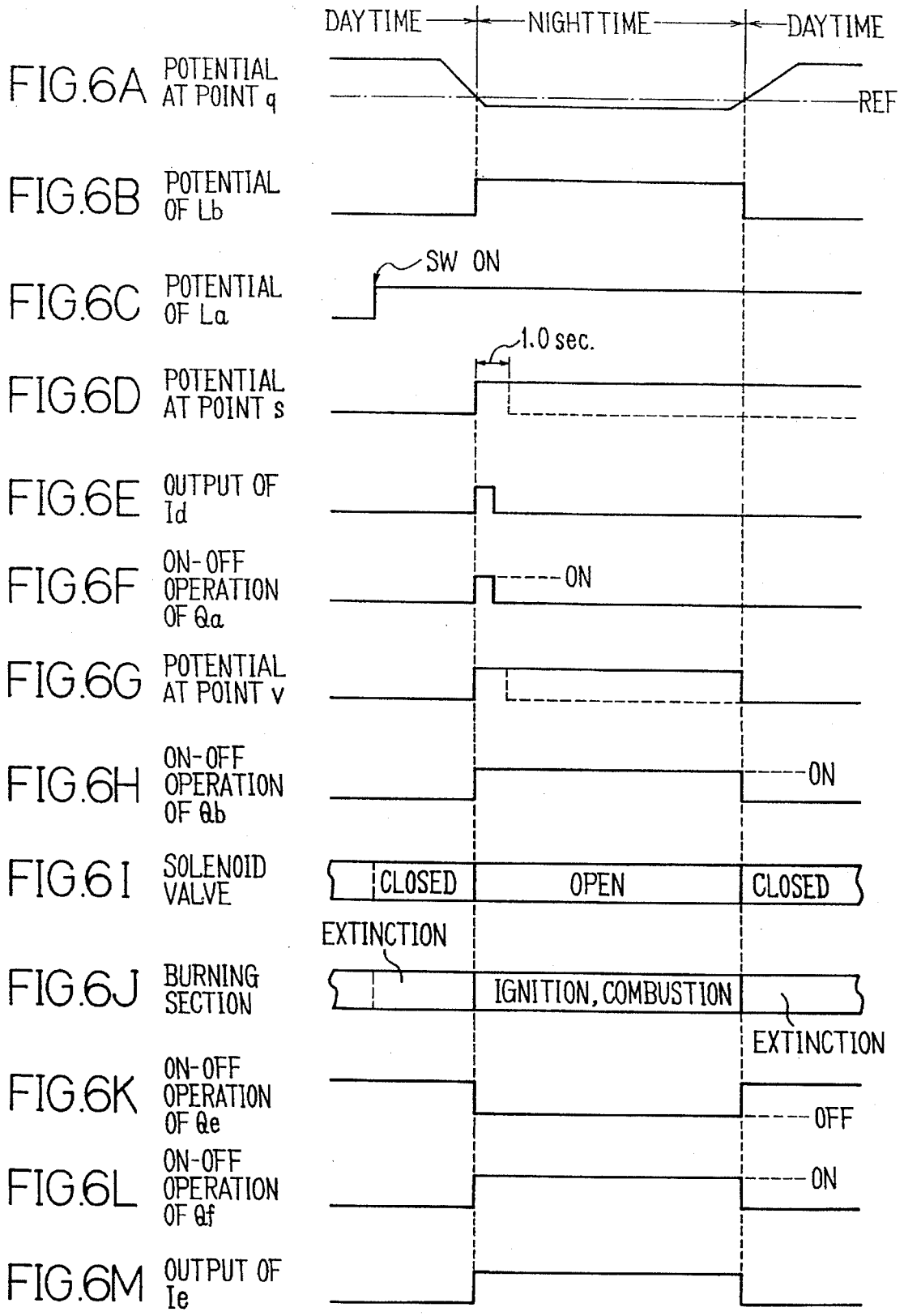
DAYTIME
NIGHT TIME
DAYTIME
FIG.6A POTENTIAL AT POINT q
REF
FIG.6B POTENTIAL OF Lb
SW ON
FIG.6C POTENTIAL OF La
1.0 sec.
FIG.6D POTENTIAL AT POINT s
FIG.6E OUTPUT OF Id
FIG.6F ON-OFF OPERATION OF Qa
ON
FIG.6G POTENTIAL AT POINT v
FIG.6H ON-OFF OPERATION OF Qb
ON
FIG.6I SOLENOID VALVE
CLOSED
OPEN
CLOSED
EXTINCTION
FIG.6J BURNING SECTION
IGNITION, COMBUSTION
EXTINCTION
FIG.6K ON-OFF OPERATION OF Qe
OFF
FIG.6L ON-OFF OPERATION OF Qf
ON
FIG.6M OUTPUT OF Ie

EXTINCTION, REIGNITION, TRIAL IGNITION, COMBUSTION
EXTINCTION

BURNING SECTION

ON-OFF OPERATION OF Qe
ON

ON-OFF OPERATION OF Qg
ON

POTENTIAL AT POINT s

POTENTIAL AT POINT t

POTENTIAL AT POINT u

ON-OFF OPERATION OF Qb
ON
15 sec.

SOLENOID VALVE
OPEN
CLOSED
CLOSED

COMBUSTION APPARATUS

BACKGROUND OF THE INVENTION

1. Field of the Invention

This invention relates to a combustion apparatus suited for use in various gaslights such as street lamps using gas, as well as other various types of gas equipment.

2. Description of the Related Art

In various gaslights such as street lamps using gas, especially those using gas, a combustion apparatus is used for setting fire to (igniting) and burning the gas. In the combustion apparatus, high voltage for igniting gas and the on-off operation of a solenoid valve for gas supply must be controlled, thus requiring a power supply for such operation. Conceivable types of power supply are alternating-current (AC) power supply and direct-current (DC) power supply.

An AC power supply is not suited for use in combustion equipment used outdoors, such as a gaslight. This is because various problems must be solved, for example, a problem associated with outdoor installation of a gaslight, a difficulty in wiring depending on the spot where a gaslight is installed, and the possibility of an electric shock.

On the other hand, a DC power supply has advantages that high safety is ensured because of low voltage, that there is no restriction on the place of installation because no cords are required for wiring, that there is no influence of line noise since a DC power supply is an independent closed circuit, that no problem is caused by power stoppage, that a DC power supply is subjected to no lightning surge when used outdoors, and that a DC power supply can be installed even in places where AC power supply cannot be used. However, since a street lamp, for example, is lit up throughout the nighttime, the power supply is used for a long period of time every day. In the case of using a battery as the power supply, a battery of long endurance type is large in size, and even if such battery is used, it must be replaced frequently, which is labor-consuming work.

A solar battery, when used as the battery, requires no replacement, but there still arises a problem of whether the solar battery can provide sufficient electric power to actuate the solenoid valve. Taking these into account, the combined use of a secondary battery, which is rechargeable, and a solar battery in particular is considered to be most suitable as the DC power supply. If these power supplies are merely combined, however, it is not always possible to construct the most efficient power supply system for various circuits constituting the combustion apparatus.

OBJECT AND SUMMARY OF THE INVENTION

This invention was created to solve the problem associated with the conventional arrangement, and an object thereof is to provide a combustion apparatus using an optimum combination of a secondary battery and a solar battery.

To achieve the above object, a combustion apparatus of this invention comprises a gas burning power supply for igniting gas, the power supply having a power supply section using a battery, an operating voltage from the power supply section is supplied at least to a gas ignition circuit, to a flame detection circuit for detecting a flame after the gas is ignited and to a solenoid valve-controlling timer circuit for controlling supply of the gas, and the solenoid valve is an energy-saving type solenoid valve whose opening and closing operation is controllable by means of the battery.

Further, to achieve the above object, a combustion apparatus of this invention comprises a gas burning power supply section for igniting gas, the power supply section includes a secondary battery and a solar battery connected in parallel with the secondary battery for charging the secondary battery, an operating voltage from the power supply section is supplied at least to a gas ignition circuit, a flame detection circuit for detecting a flame after the gas is ignited, and a solenoid valve-controlling timer circuit for controlling supply of the gas, a day/night discrimination circuit is provided as needed in association with the power supply section, and the ignition circuit, the flame detection circuit and the timer circuit are individually set in operation in accordance with a day/night discrimination output during the nighttime.

As seen from FIG. 2, the potential at point r is high during the daytime; therefore, the output of an inverter Ia provided in a power line Lb is inverted to "L" level and thus the potential at point s is "L" level. Accordingly, the output of an inverter Ic is "L" level and a transistor Qb is in an off state. Since the output of an inverter Ib is "H" level, the potential at point v is equal to the potential of a power line La. Thus, the output of an inverter Id is "L" level and a transistor Qa is in an off state. As a result, a solenoid valve 20 is not energized, so that gas is not supplied to a burning section 130.

In the nighttime, the aforementioned elements operate conversely. Specifically, the transistors Qa and Qb are turned on and the solenoid valve 20 is actuated, so that gas is supplied to the burning section 130. Since the potential at point u becomes "H" level, a transistor Qg is turned on by the output from an inverter If, whereby the power line La connected to an ignition circuit 30 is closed and electric power is supplied. Consequently, a high voltage is generated by the ignition circuit 30 so as to ignite (set fire to) the gas by means of a flame rod 3.

After the gas is ignited, a current path between the flame rod 3 and a burner 2 is closed by a flame 4, and a DC voltage rectified by the flame 4 is applied to the source of a transistor Qe in a flame detection circuit 50, so that the transistor Qe is turned off. As a result, a transistor Qf is turned on, the output of an inverter Ie turns to "H" level, and the potential at point s in FIG. 2 becomes "H" level. Accordingly, while the flame 4 remains normal after the gas is ignited, the transistor Qb alone maintains its on state, so that the gas keeps burning.

In this manner, gas is automatically ignited to burn only during the nighttime. In the event the flame goes out halfway, the transistor Qe resumes on state and the succeeding-stage transistor Qf is turned off. Since the potential at point s is held at "H" level, the solenoid valve 20 remains open. At this time, the potential of the power line Ld is "H" level and thus the output of the inverter If is "L" level, whereby a transistor Qg is turned on. Consequently, the ignition circuit 30 is started again to reignite the gas.

If the gas does not burn due to failure of the reigniting operation, a discharge circuit 73 starts discharging as indicated by the arrow, and upon lapse of 15 seconds, for example, the output of the inverter Ib is inverted to "H" level, so that the energization of the solenoid valve 20 stops and the valve 20 is closed. This prevents the dissipation of a large quantity of gas.

BRIEF DESCRIPTION OF THE DRAWINGS

FIG. 6 is a timing chart showing an example of an operation sequence of the combustion apparatus;

DESCRIPTION OF THE PREFERRED EMBODIMENT

A combustion apparatus according to one embodiment of this invention will be hereinafter described in detail with reference to the drawings, wherein the combustion apparatus is applied to a gaslight.

Figure 9:
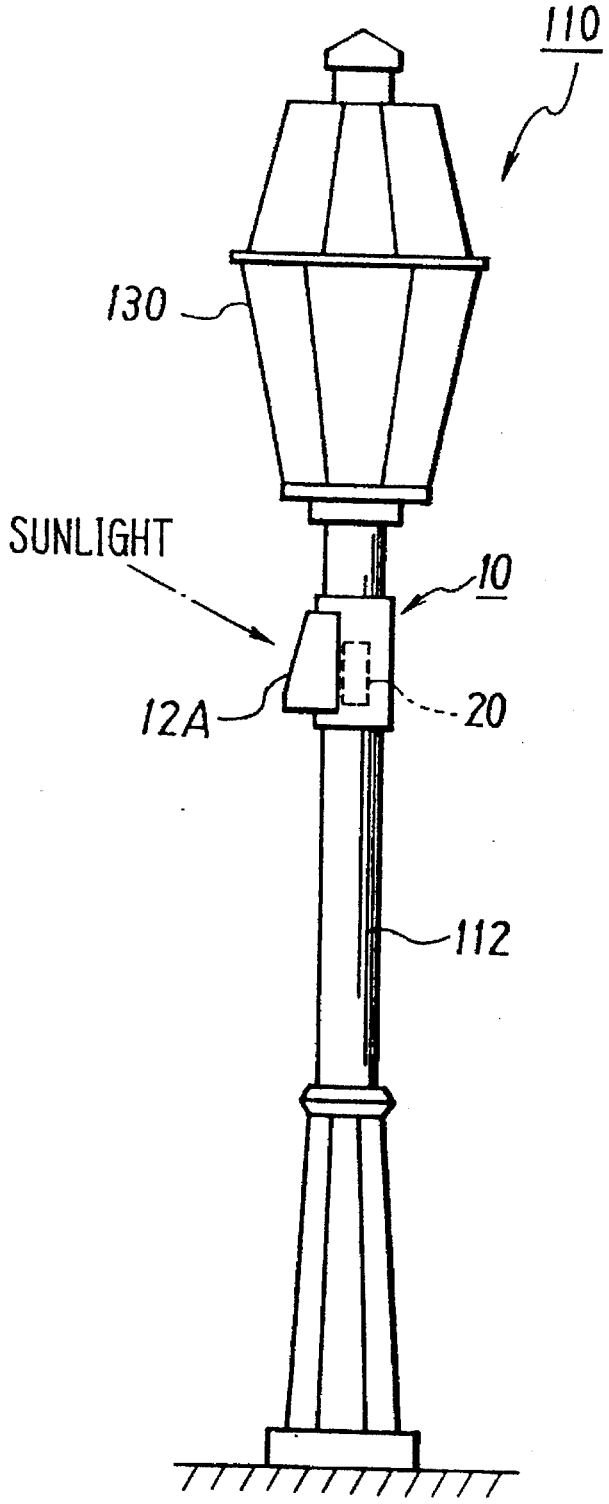
FIG. 9 is a view of a gaslight equipped with the combustion apparatus according to this invention.
Figure 10:
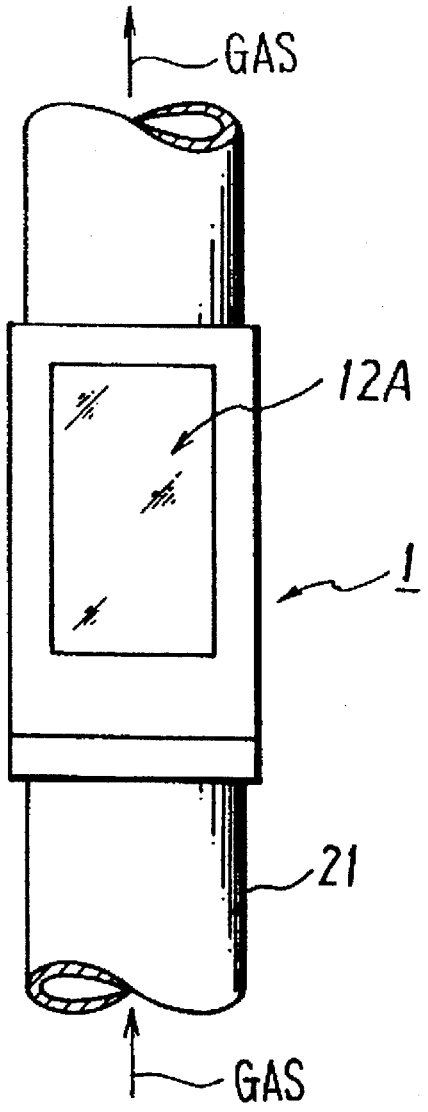
FIG. 10 is a plan view of a solar battery side.

FIGS. 9 and 10 illustrate an example of a gaslight 110, in which a burning section 130 is attached to a distal end of a tubular post 112 with a predetermined length, and a gas pipe 21 is extended through the post 112. A combustion apparatus 1 is mounted to the post 112 at a location close to the burning section 130. According to this invention, a combination of two types of battery, that is, a secondary battery and a solar battery, is used as a power supply section arranged in the combustion apparatus 1, as described later. Accordingly, a solar panel 12A is mounted for collecting sunlight, as shown in FIG. 10.

Figure 11:
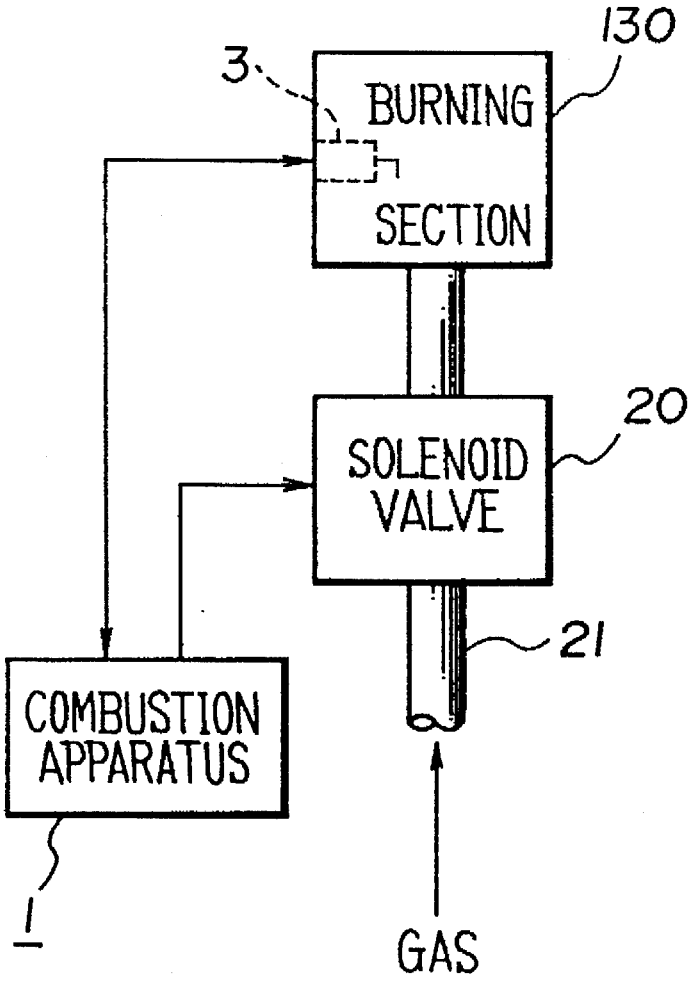
FIG. 11 is a diagram illustrating the relationship between the combustion apparatus and the gaslight.

The combustion apparatus 1 controls a solenoid valve 20 to thereby control the supply of gas, and also carries out ignition control, flame monitoring, etc. for the burning section 130, as shown in FIG. 11. As the burning section 130, a mantle or the like is used to provide warm illumination of gas flame, as conventionally known. No pilot burner is provided in the burning section 130, but this invention is applicable to a burning section of ordinary gas combustion equipment using a pilot burner.

Figure 1:
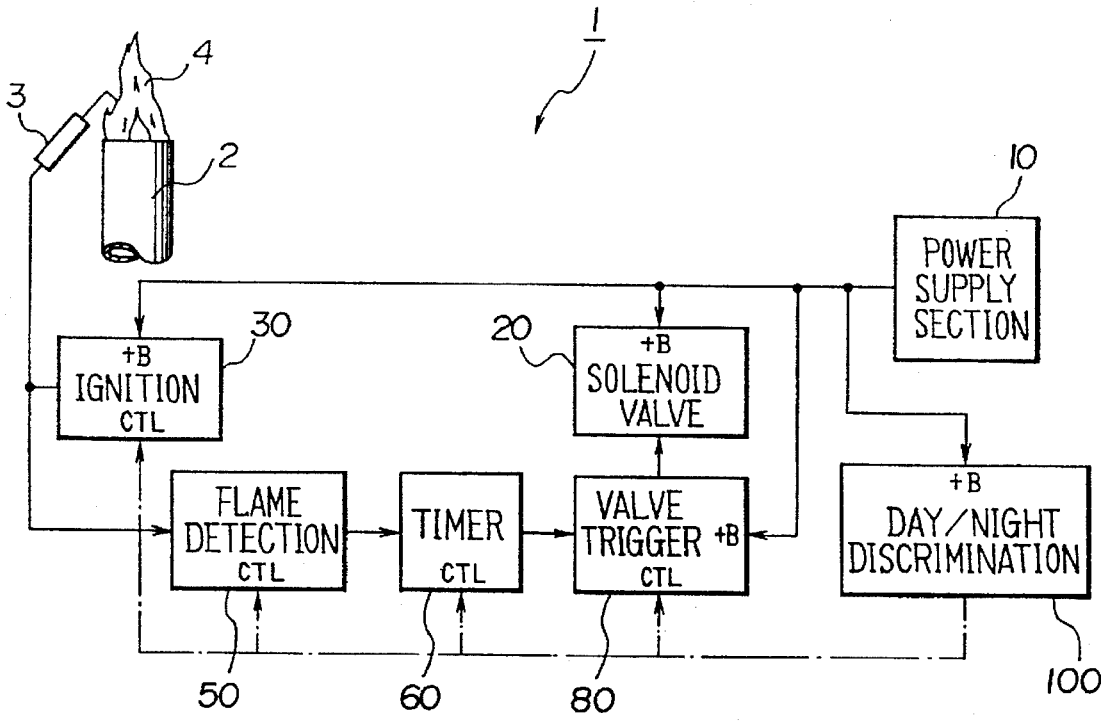
FIG. 1 is a system diagram showing an example of a combustion apparatus according to this invention.

FIG. 1 is a system diagram illustrating the combustion apparatus 1 according to this invention. During the nighttime, the solenoid valve 20 is actuated by electric power supplied from a power supply section 10, so that gas is fed to the burning section 130. Simultaneously with the start of gas supply, an ignition circuit 30 operates to apply a high voltage (about 15,000 volts) to a flame rod 3, whereby a spark occurs between the rod 3 and a burner 2 to ignite and burn the gas.

After the gas starts to burn, the flame rod 3 functions as a flame sensor. In accordance with the output from the flame rod 3, a flame detection circuit 50 operates, and a timer circuit 60 is controlled in accordance with a detection output from the circuit 50. The timer circuit 60 has a function to actuate the solenoid valve 20 for a predetermined period at the time of igniting gas, as well as a control function to continue reigniting operation for a predetermined time in case the flame goes out halfway, and if the reigniting fails during the predetermined time, close the solenoid valve 20. Namely, the timer circuit 60 is designed to prevent the leak of a large quantity of gas, thereby ensuring safety.

The solenoid valve 20 is controlled by a solenoid valve trigger circuit (solenoid valve-controlling trigger circuit) 80, and the solenoid valve trigger circuit 80 is controlled in accordance with the timer output from the timer circuit 60. A day/night discrimination circuit 100 is provided in association with the power supply section 10, and the aforementioned circuits 20, 30, 50, 60 and 80 are supplied with operating power only during the nighttime to perform respective predetermined operations.

Figure 4:
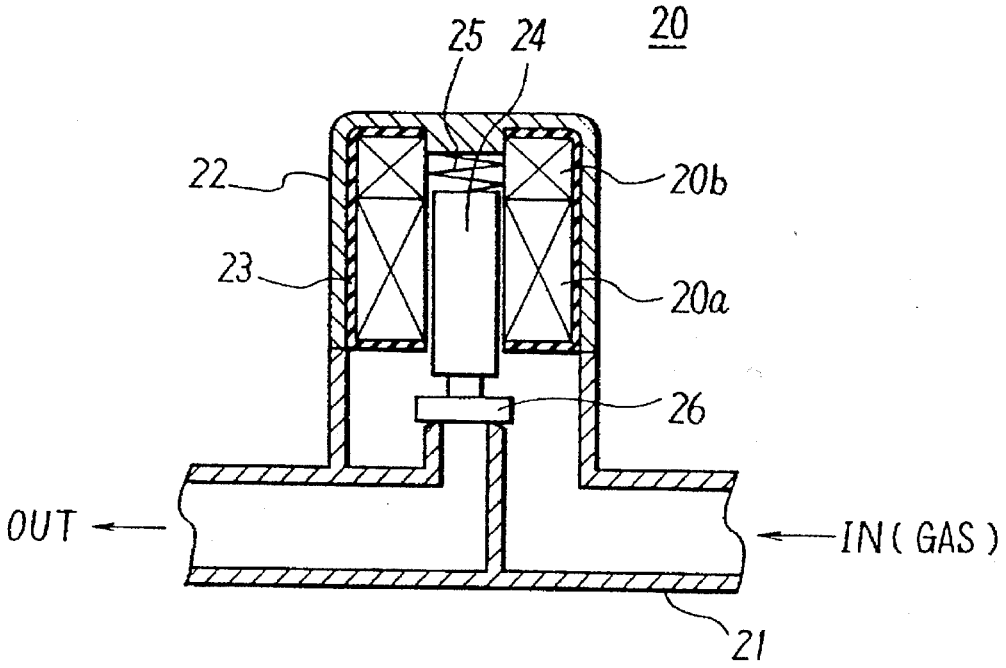
FIG. 4 is a sectional view showing an example of a solenoid valve.

As the solenoid valve 20, a power-saving type shown is FIG. 4 is used. As is known in the art, in order to attract an on-off valve member, a current of about 800 mA to 1 A must be passed through the attracting coil given that an operating voltage is 3 volts. If, however, such current is continuously passed, the power supply (battery) is exhausted in a very short period of time.

Figure 5:
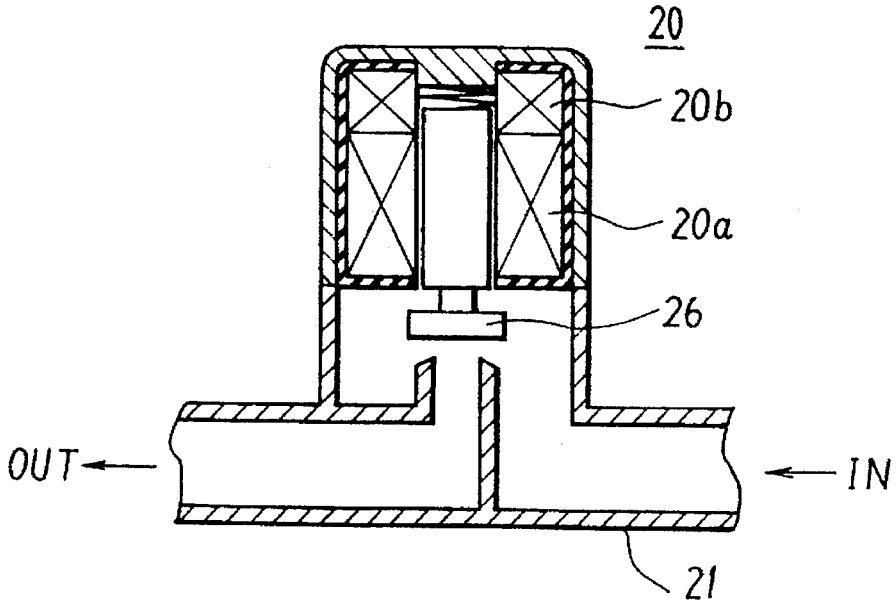
FIG. 5 is a sectional view showing an operated state of the valve of FIG. 4.

In view of this, the attracting coil is divided into two systems, that is, first and second attracting coils **20*a* and 20*b*, as shown in FIG. 4., and is mounted inside the case 22 with a packing 23. First, a large current is passed through both the attracting coils 20*a* and 20*b* to attract a plunger 26 attached to the on-off valve. After the plunger is attracted, a small current (e.g., 2 mA) is passed through the second attracting coil 20*b* to keep the valve open. This is because once the plunger 26 is attracted as shown in FIG. 5, only a small current supply is sufficient to maintain the valve open state. With this arrangement, it is possible to prevent the exhaustion of the battery even if the solenoid valve 20** is used for a long period of time.

Figure 2:
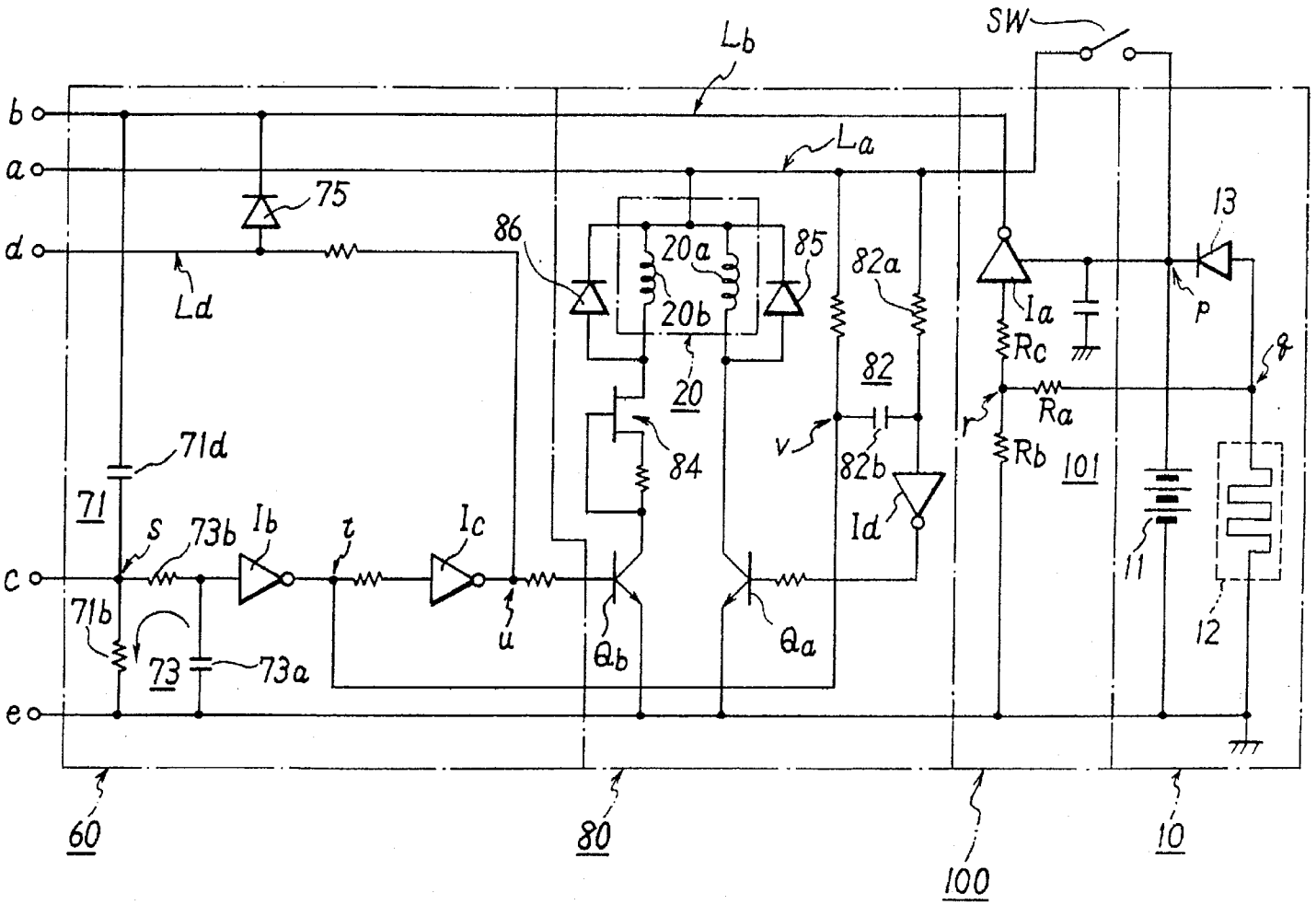
FIG. 2 is a diagram showing a specific example of connections of a part of the combustion apparatus.
Figure 3:
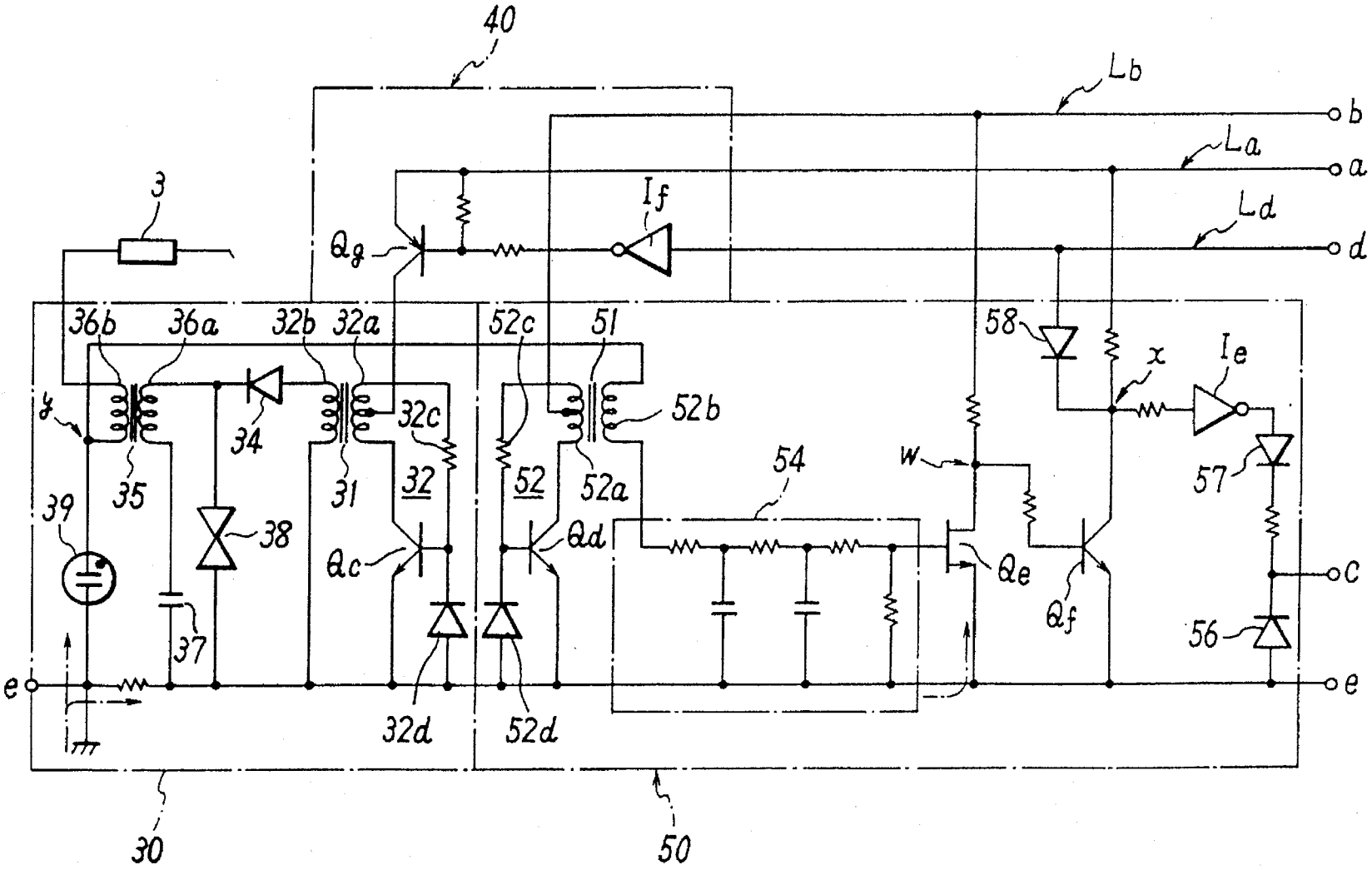
FIG. 3 is a diagram showing a specific example of connections of another part of the combustion apparatus.

FIGS. 2 and 3 illustrate a specific example of the combustion apparatus 1 shown in FIG. 1.

As shown in FIG. 2, the power supply section 10 comprises a rechargeable secondary battery 11, such as a nickel-cadmium battery, and a solar battery 12, and these batteries are connected in parallel with each other via a diode 13. The diode 13 serves as a reverse-current preventing diode for preventing the voltage of the secondary battery 11 from being supplied to the solar battery (12) side during the nighttime.

The secondary battery 11 uses two series-connected batteries having a terminal voltage of 1.5 volts, to provide an operating voltage of 3 volts. Assuming that the duration of illumination per day is 8 to 12 hours, the secondary battery has a capacity such that it can be used for five consecutive non-sunshine days. The solar battery 12 is used to recharge the secondary battery 11, and the power generation capacity of the solar battery used in this example is approximately 5 volts at 50 mA.

The voltage supplied via a power line La branching off from point p is used as operating power for the ignition circuit 30, the flame detection circuit 50, the solenoid valve trigger circuit 80, etc. A switch SW, which is provided in the power line La, is turned on when the combustion apparatus 1 is installed in a gaslight (C in FIG. 6). This is because the combustion apparatus 1 itself is designed to operate during the nighttime and thus may operate if it is kept in a dark place.

The voltage supplied via another power line Lb branching off from point p is used as a voltage for controlling the operation states, and is connected to the day/night discrimination circuit 100. The day/night discrimination circuit 100 includes an inverter Ia connected to the power line Lb, and the inverting operation of this inverter Ia is controlled in accordance with the magnitude of the induced voltage of the solar battery 12. To this end, a voltage divider 101 composed of resistors Ra and Rb is connected between a terminal q of the solar battery 12 and the ground, and a divided voltage (A in FIG. 6) of the solar battery 12, obtained at junction point r, is applied to the inverter Ia via a resistor Rc.

The potential at point q is high during the daytime and is low during the nighttime; therefore, the output of the inverter Ia is inverted when the terminal voltage of the solar battery 12 becomes lower than a predetermined threshold REF (A in FIG. 6). Thus, as shown in B of FIG. 6, the potential of the power line Lb on the output side of the inverter Ia is "L" level during the daytime, and is inverted from "L" to "H" when night falls.

During the daytime, since the potential of the power line Lb is "L" level, the operating voltage is zero, so that an ignition control circuit 40 and the solenoid valve trigger circuit 80 shown in FIGS. 2 and 3 do not operate. A capacitor 71*d* constituting a time constant circuit 71 in the timer circuit 60 is in a discharged state because of the low-level potential of the power line Lb. Thus, an inverter Ib is supplied with a low-level input (potential at point s; D in FIG. 6) and provides a high-level output (potential at point t), and the potential at point v in the day/night discrimination circuit 100 is in "H" state. Consequently, the potentials at both terminals or a capacitor 82*b* provided in the solenoid valve trigger circuit 80 are equal and the charge of the capacitor 82*b* is zero; therefore, an inverter Id provides a low-level output (E in FIG. 6). As a result, a transistor Qa is in an off state (F in FIG. 6).

In this case, the potential level at point t is high, and therefore, the succeeding-stage inverter Ic provides a low-level output (potential at point u) which turns off a transistor Qb (H in FIG. 6). Consequently, the solenoid valve 20 is not energized and the supply of gas to the burning section 130 is blocked (I and J in FIG. 6).

Since the potential level at point u in the timer circuit 60 is low, the potential level of a power line Ld also is low. Accordingly, the output of an inverter If in the ignition control circuit 40 is held at high level and a transistor Qg continues to assume a cutoff state. As a result, power supply to the ignition circuit 30 is cut off and no igniting operation is carried out. Namely, during the daytime, combustion at the burning section 130 is completely stopped.

On the other hand, when the potential at point q in the day/night discrimination circuit 100 becomes lower than or equal to the day/night discrimination threshold REF as the area around the gaslight becomes dark, the output of the inverter Ia is inverted, so that the potential of the power line Lb on the output side of the inverter Ia is inverted to high level. Thereupon, the time constant circuit 71 including the capacitor 71*a* and a resistor 71*b* starts charging operation, and in this example, the potential at point s turns to high level in about one second. Accordingly, the potential at point t (output terminal of the inverter Ib) turns to low level, and the capacitor 82*b* of a time constant circuit 82, which performs a derivative action, starts charging operation. As a result, the output of the inverter Id is inverted to high level for a time period (in this example, 0.5 second) determined by the time constant $\tau$ of the time constant circuit 82, whereby the transistor Qa is turned on for this time period (F in FIG. 6).

Simultaneously with this, the potential at point u is also inverted to high level. Therefore, the transistor Qb turns on at the same time that the transistor Qa turns on, whereby current supply to the two coils 20*a* and 20*b* of the solenoid valve 20 starts and the valve 20 is opened. Consequently, gas is supplied to the burning section 130.

Since the potential of the power line Ld turns to high level because of the low-to-high inversion of the potential at point u, the transistor Qg turns on at this time, to supply operating power to the ignition circuit 30 via the power line Lb.

The ignition circuit 30 includes a pair of transformers 31 and 35, and an oscillation circuit 32 is connected to the primary coil 32*a* of the preceding-stage oscillation transformer 31. The oscillation circuit 32 has a closed loop arrangement including the primary coil 32*a* and comprises an oscillation transistor Qc, a resistor 32*c* and a diode 32*d* to constitute a blocking oscillator. The oscillation frequency of this oscillator is about 40 kHz, but may be set to a desired value.

The oscillation output transmitted to the secondary coil 32*b* is supplied to a charging capacitor 37 through a rectifier diode 34 and the primary coil 36*a* of the high-voltage transformer 35. When the voltage boosted by the capacitor 37 exceeds a break voltage of switching means 38 such as a two-terminal bi-directional thyristor (silicon symmetrical switch), the switching means 38 turns on and a boosted high voltage is induced on the side of the secondary coil 36*b*. In this example, a high voltage of about 15,000 volts is obtained.

This high voltage is applied to the flame rod 3, whereby a discharge occurs between the flame rod 3 and the burner 2 so that the gas may be ignited. When the gas ignites and burns, a current path is formed between the flame 4 of burning gas and the burner 2. As is conventionally known, the flame 4 provides a rectifying effect with the flame rod 3 and the burner 2 serving as anode and cathode, respectively. Due to this rectifying effect, a current loop is formed, as indicated by the chain line in FIG. 8.

Thus, after the ignition, the flame rod 3 functions as a flame sensor, the detection output of which is supplied to the flame detection circuit 50 shown in FIG. 3. The flame detection circuit 50 has an oscillation transformer 51, and an oscillation circuit 52 is provided so as to include the primary coil 52*a* of the transformer 51. Like the aforementioned oscillation circuit 32, this oscillation circuit 52 also comprises a resistor 52*c* and a diode 52*d*, in addition to an oscillation transistor Qd. The oscillation frequency is approximately 40 kHz, but may be set to a desired value.

Figure 8:
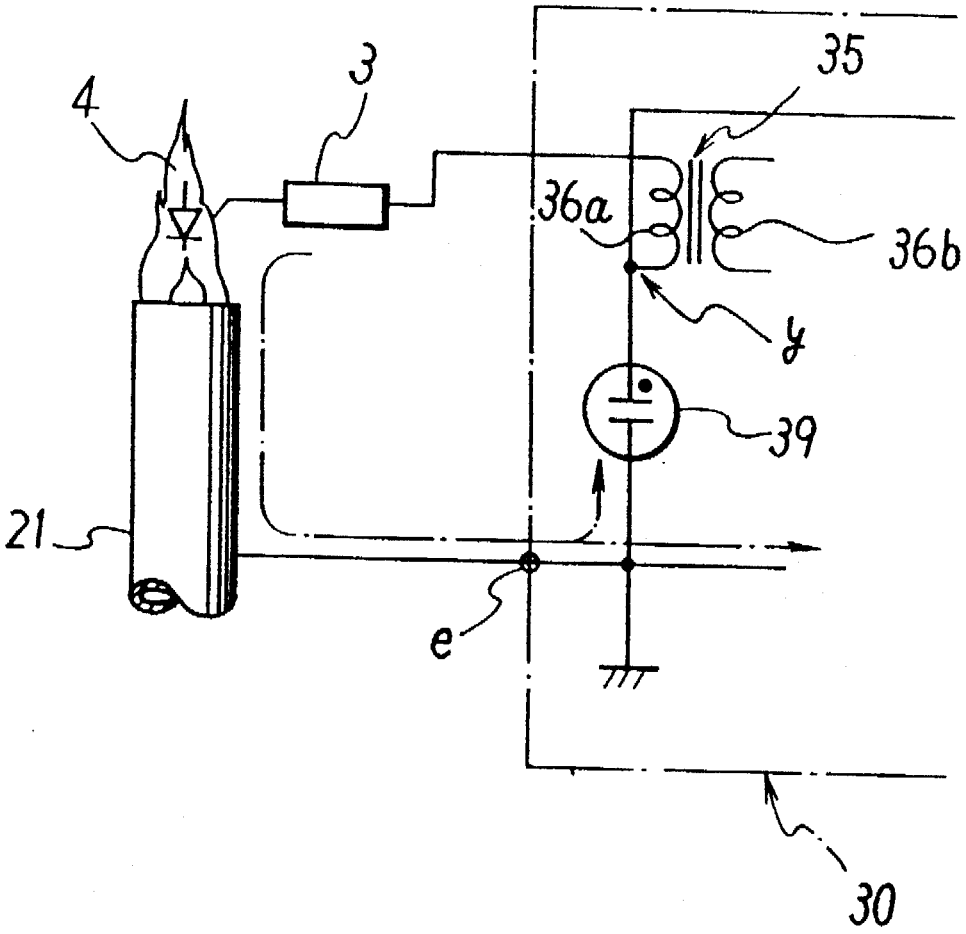
FIG. 8 is a diagram of an equivalent circuit including a flame.

The oscillation output is supplied as a flame detection signal to the flame rod 3 serving as the flame sensor, through the secondary coil 36*b* of the boosting transformer 35. The secondary coil 52*b* of the oscillation transformer 51 is connected to an FET-type transistor Qe via a high-frequency filter 54, and the source of the transistor Qe is connected to terminal e. The terminal e is connected to the gas pipe 21, as shown in FIG. 8.

Accordingly, when the gas burns and the current loop including the flame 4 is formed, a 40-kHz flame detection signal is rectified by the flame 4, and the rectified output is applied to the source of the transistor Qe via the loop indicated by the dashed arrows in FIG. 3. Since the transistor Qe is an FET, it is in an on state before the current loop is formed, as shown in K of FIG. 6. When the current loop is formed and a predetermined current output (DC voltage) is applied between the source and gate of the transistor Qe, the transistor Qe is biased in the reverse direction and thus turns off.

Thereupon, the potential at point w turns to high level, and the succeeding-stage transistor Qf turns on (L in FIG. 6) and pulls down the potential at point x to low level. Accordingly, the potential of the power line Ld, which has so far been held at high level, is inverted to low level, so that the ignition control circuit 40 operates to cut off the supply of operating power to the ignition circuit 30, thus terminating the igniting operation.

The output of an inverter Ie, which is connected to the collector of the transistor Qf, turns to high level as shown in M of FIG. 6, and therefore, the potential of terminal c shown in FIG. 2, that is, the potential at point s, is held at high level. As a result, the transistor Qb remains turned on, whereby the solenoid valve 20 is kept open. A constant-current circuit 84 provided in the current path of the transistor Qb permits a minimum constant current (low current) to pass through the second attracting coil 20*b* even when the potential of the power line La lowers, thereby preventing the current consumption of the secondary battery 11.

The transistor Qa, to which the first attracting coil 20*a* is connected, is associated with the time constant circuit 82. Accordingly, upon lapse of the time constant τ (about 0.5 second) after the output of the inverter Ia is inverted, the potential of the power line La is applied to the input of the inverter Id, whereby the output of the inverter Id again turns to low level and the transistor Qa is turned off. Consequently, the solenoid valve 20 is actuated solely by the second attracting coil 20*b*.

Once the gas starts to burn, the above-described operation is continued. In the event the flame goes out for some reason, the reigniting operation described below is carried out, and if the reigniting operation fails, the solenoid valve 20 is automatically closed to thereby ensure safety (see FIG. 7).

Figures 7A, 7B, 7C, 7D, 7E, 7F, 7G, 7H:
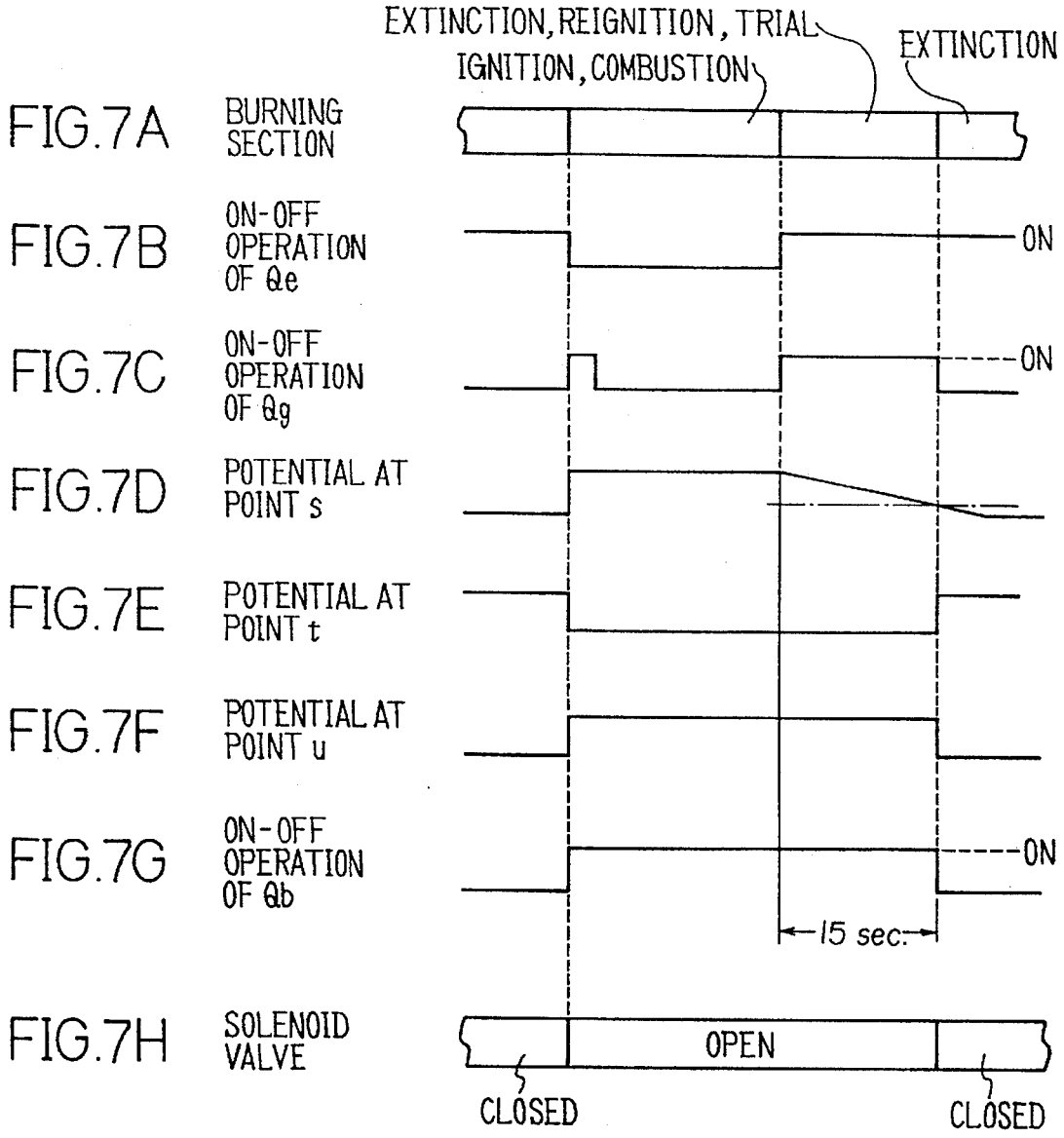
FIG. 7 is a timing chart showing an example of another operation sequence of the combustion apparatus.

If the flame of burning gas goes out, the current loop including the flame 4 is broken, so that the transistor Qe of the flame detection circuit 50 resumes on state (A and B in FIG. 7). Thereupon, the transistor Qf is turned off and the potential at point x turns to high level, whereby the potential of the power line Lb is turned to high level. Accordingly, the output level of the inverter If is inverted into low level and the transistor Qg resumes on state (C in FIG. 7). Since the operating voltage is supplied to the ignition circuit 30, the igniting operation is restarted.

If the gas starts to burn again due to this reigniting operation, then the above-described burning operation restarts. On the other hand, if the gas does not start to burn because of failure of the reigniting operation, the below-mentioned operation is performed. When the reigniting is carried out, the potential at point x turns to high level whereas the potential of terminal c turns to low level. At this time, therefore, a time constant circuit 73 (composed of a capacitor 73*a* a and resistors 73*b* and 71*b*) connected to the input of the inverter Ib shown in FIG. 2 starts discharging operation (D in FIG. 7).

The time constant τ of this time constant circuit 73 is set to 15 seconds or thereabouts. Thus, when 15 seconds have elapsed after the start of the reigniting operation, the input of the inverter Ib turns to low level, so that the output of the inverter Ib, that is, the potential at point t, turns to high level (E in FIG. 7). As a result, the transistor Qb is turned off and the solenoid valve 20 is closed (F, G and H in FIG. 7). Namely, in the case where the gas does not start to burn due to failure of the reigniting operation, a safety operation is automatically executed in such a way that the supply of gas is stopped upon lapse of the 15-second trial period.

In FIG. 3, a diode 56 serves to form a discharge path for the capacitor 71*a*, and a diode 57 serves as a reverse-current preventing diode. A diode 58 serves to pull the potential of the power line Ld down to the potential level at point x, in order to turn off the transistor Qg at the time of ignition.

When the current path is formed via the flame 4 as a result of igniting operation, a neon lamp 39 in FIG. 3 is lit up and the potential at point y is held at a predetermined potential (e.g., 50 to 60 volts). Consequently, the potential on the side of the secondary coil 52*b* of the oscillation transformer 51 is restricted to low potential, otherwise the high voltage applied to the flame rod 3 is applied to the oscillation transformer 51, causing the possibility of the transformer 51 being broken.

With the arrangement described above, the combustion apparatus can advantageously be operated as if it uses an AC power supply, even in severe outdoor environments wherein the use of AC power supply is impossible. Also, since the gaslight can be lit up every day unless non-sunshine day continues longer than five days, there are no restrictions on the environment in which the combustion apparatus is used. Further, the combustion apparatus requires no replacement of batteries before the service life of the secondary battery and solar battery comes to an end, thus greatly facilitating the maintenance and inspection. Thus, the maintenance cost can be reduced correspondingly.

In the above description of the embodiment, the invention is applied to a combustion apparatus for a gaslight, but it can be applied to a combustion apparatus of other gas equipment using gas as fuel.

For example, in the case where this invention is applied to a stove used indoors, the combustion apparatus having the arrangement shown in FIGS. 2 and 3 can be used as it is. Also in this case, the solar battery is charged by indoor lighting equipment, whereby the service life of the power supply battery is prolonged. Even in cases where one goes out forgetting to cut the power supply to the stove, the combustion apparatus can be automatically turned off by operating the day/night discrimination circuit when the light in the room in which the stove is placed is turned off and the room becomes dark. Thus, the day/night discrimination circuit can be used as safety means.

Where the invention is applied to an indoor stove, the arrangement of the combustion apparatus shown in FIGS. 2 and 3 may be further simplified. Since the combustion apparatus is used indoors, the power supply section may include only a secondary battery (in this case, a primary battery alone may be used). By omitting the day/night discrimination circuit, the apparatus can be further simplified in structure. Thus, the combustion apparatus from which the solar battery and the day/night discrimination circuit are omitted can be used as a combustion apparatus for a stove.

As described above, in the combustion apparatus according to this invention, an energy-saving solenoid valve, a secondary battery and a solar battery are ingeniously combined so that the apparatus may operate only during the nighttime. Accordingly, the combustion apparatus can be used even in places where AC power supply cannot be used, and since the secondary battery is recharged during the daytime, the interval between battery replacements for the combustion apparatus can be greatly prolonged. As a result, the frequency of maintenance and inspection can be drastically reduced, permitting a significant reduction in the maintenance cost.

Even in the case where the flame of burning gas goes out for some reason, reigniting operation is automatically performed, and if the reigniting fails during the trial period, the solenoid valve is immediately closed so that gas may not be dissipated. Thus, a safety mechanism is employed to ensure safety. If the flame goes out due to a gust of wind or the like, safety is in no way lowered. Consequently, this invention can be very advantageously applied to a combustion apparatus for gas equipment as described above, without being influenced by power stoppage or other troubles.

What is claimed is:

1. A combustion apparatus for igniting gas delivered to a gas burner to form a gas flame, said combustion apparatus comprising:

a solenoid valve for controlling supply of gas to the gas burner, the solenoid valve having first and second attracting coils, a gas ignition circuit for ignition gas at the gas burner, a flame detection circuit for detecting the gas flame after the gas has been ignited, the flame detection circuit having a flame rod and an oscillation transformer, a timer circuit for controlling the solenoid valve, the timer circuit being responsive to a command to ignite the gas by supplying current to the first and second attracting coils of the solenoid valve at a first level for a predetermined interval for opening the valve and thereafter supplying current to the second attracting coil of the solenoid valve at a second level, lower than said first level, for holding the valve open, a battery, and a power supply circuit for supplying operating current from the battery to the gas ignition circuit, the flame detection circuit and the timer circuit.

2. A combustion apparatus according to claim 1, wherein the battery is a secondary battery and the apparatus further comprises a solar battery connected in parallel with the secondary battery for charging the secondary battery.

3. A combustion apparatus according to claim 1, comprising an oscillation circuit and wherein the oscillation transformer has a primary winding that is part of the oscillation circuit and a secondary winding that is connected to the flame rod and to the timer circuit, whereby the flame detection circuit provides a signal to the timer circuit when it detects a flame at the burner, and wherein the timer circuit is responsive to the signal provided by the flame detection circuit to supply current to the second attracting coil at said second level.

4. A combustion apparatus for igniting gas delivered to a gas burner to form a gas flame, said combustion apparatus comprising:

a solenoid valve control circuit for controlling a solenoid valve for supplying gas to the burner, the solenoid valve having first and second attracting coils, a gas ignition circuit for igniting gas at the gas burner, a flame detection circuit for detecting the gas flame after the gas has been ignited, the flame detection circuit having a flame rod and an oscillation transformer, a power supply circuit including a secondary battery and a solar battery connected in parallel with the secondary battery for charging the secondary battery, and a day/night discrimination circuit associated with the power supply circuit for providing a day/night discrimination output during nighttime, and wherein the solenoid valve control circuit, the gas ignition circuit and the flame detection circuit are responsive to the day/night discrimination output.

5. The combustion apparatus according to claim 4, wherein the day/night discrimination circuit includes an inverter for inverting the polarity of a terminal voltage of the secondary battery through detection of a terminal voltage of the solar battery.

6. A combustion apparatus according to claim 4, further comprising a timer circuit for controlling the solenoid valve, the timer circuit being responsive to a command to ignite the gas by supplying current to the first and second attracting coils of the solenoid valve at a first level for a predetermined interval for opening the valve and thereafter supplying current to the second attracting coil of the solenoid valve at a second level, lower than said first level, for holding the valve open.

7. A combustion apparatus according to claim 6, comprising a battery and a power supply circuit for supplying operating current from the battery to the gas ignition circuit, the flame detection circuit and the timer circuit.

8. A combustion apparatus according to claim 6, comprising an oscillation circuit and wherein the oscillation transformer has a primary winding that is part of the oscillation circuit and a secondary winding that is connected to the flame rod and to the timer circuit, whereby the flame detection circuit provides a signal to the timer circuit when it detects a flame at the burner, and wherein the timer circuit is responsive to the signal provided by the flame detection circuit to supply current to the second attracting coil at said second level.

* * * * *